United States Patent [19]

Graham

[11] 3,953,097

[45] Apr. 27, 1976

[54] CONNECTOR AND TOOL THEREFOR

[75] Inventor: Gerald Graham, Kleinburg, Canada

[73] Assignee: International Telephone and Telegraph Corporation, New York, N.Y.

[22] Filed: Apr. 7, 1975

[21] Appl. No.: 565,343

[52] U.S. Cl. ..... 339/37; 339/85; 81/90 C

[51] Int. Cl.[2] ..... H01R 13/54

[58] Field of Search ..... 339/36–39, 339/82–87

[56] References Cited

UNITED STATES PATENTS 1,998,129 4/1935 Fullman ..... 339/37

3,861,770 1/1975 Horak ..... 339/37

*Primary Examiner*—Roy Lake
*Assistant Examiner*—Neil Abrams
*Attorney, Agent, or Firm*—Thomas L. Peterson

[57] ABSTRACT

A connector which may be connected to a fitting, such as a CATV outlet, without the use of a tool, but which requires a tool for removal of the connector from the fitting. The connector comprises an outer body and an inner rotatable shell with a one-way driving means therebetween. A special tool is disclosed for uncoupling the connector from the fitting.

1 Claim, 5 Drawing Figures

CONNECTOR AND TOOL THEREFOR

BACKGROUND OF THE INVENTION

The present invention relates generally to a connector and, more particularly, to a connector for a CATV outlet which requires the use of a special tool for removing the connector from the outlet.

It is generally desirable to provide a theft proof connector or terminator for a CATV outlet which requires a special tool to remove the connector from the outlet. The connector may be coupled to a coaxial cable leading to a television set wherein it is desirable that the cable not be removed from the CATV outlet by the homeowner. Alternatively, the connector may be a termination device which simply closes off the CATV outlet and thereby prevents a homeowner from coupling his own coaxial cable to the outlet.

Connector devices of this general type normally have an outer sheel and a free running inner body within the shell. To rotate the connector a tool is used which connects directly to the inner body. With this arrangement, it is necessary to use the tool both to remove the connector from the CATV outlet, and also to install the connector thereon. It is advantageous for the cable TV installer to mount the connector or terminator device on the CATV outlet without the use of a tool in order to save time. It is therefore the object of the present invention to provide a connector or terminator device which may be installed to an outlet or fitting without the use of a tool, but which requires a special tool for removal of the device from the fitting.

SUMMARY OF THE INVENTION

According to the principal aspect of the present invention, there is provided a connector for a CATV outlet or similar fitting which may be installed onto the outlet without the use of a tool, but which requires a special tool for removal from the outlet. The term "connector" utilized herein and in the claims is intended to embrace both an electrical connector which terminates one or more conductors in a cable, or a termination device which simply closes off the CATV outlet. The connector of the present invention comprises a hollow shell having a body rotatable inside the shell. The shell and body are constructed so that the body cannot be removed from the shell. The forward end of the body is formed with means for releasably coupling the body to the CATV outlet upon rotation of the body in one direction. A pair of spaced recesses open at the forward end of the body and are adapted to receive a special tool therein for rotating the body. A one-way driving means is provided in the shell which engages the body to effect rotation of the body in said one direction upon rotation of the shell in the same direction. Thus, when the shell is rotated in such direction, the body therein likewise rotates to effect coupling of the body to the outlet. The one-way driving means does not effect rotation of the body upon rotation of the shell in the opposite direction so that the body and therefore the connector cannot be uncoupled from the outlet by rotation of the shell.

According to another aspect of the invention, there is provided a tool for rotating the body inside the shell of the connector described hereinabove in the opposite direction to remove the connector from the outlet. The tool has a pair of forwardly extending arms thereon terminating in hooked elements which extend inwardly toward each other. The hook elements are circumferentially spaced from each other corresponding to the circumferential spacing of the recesses in the body within the connector shell. The hook elements define rearwardly extending fingers which are positioned so as to be receivable in the recesses in the forward end of the connector body when the tool is placed over the shell and shifted rearwardly. Once the fingers are engaged within the recesses in the connector body, the tool is rotated in the uncoupling direction, removing the body and hence the connector from the CATV outlet.

DESCRIPTION OF THE PREFERRED EMBODIMENTS

Figure 1:
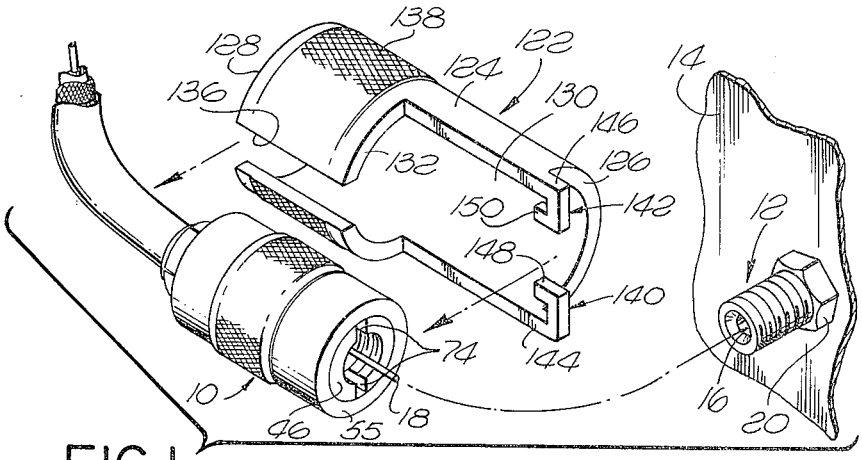
FIG. 1 is a perspective view of the connector of the present invention terminating a coaxial cable, a CATV outlet to which the connector is to be coupled and the tool of the present invention positioned to be mounted over the connector.

Referring now to FIGS. 1–4 in detail, there is illustrated the connector 10 of the present invention which is mateable with a CATV outlet 12 mounted in a wall 14. The outlet 12 is in the form of a threaded fitting having a central socket contact 16 therein mateable with a pin contact 18 of the connector when the connector is coupled to the outlet 12. The CATV outlet is fixed to the wall 14 by a pair of jam nuts 20 on opposite sides of the wall. The outlet has a pair of terminals 22, only one being seen in FIG. 4, for connection to the two leads of a TV aerial, not shown.

The connector 10 terminates a coaxial cable 24 comprising an inner conductor 26 and an outer metallic braid 28 surrounding the inner conductor and separated thereform by an insulation layer 30. An insulation sleeve 32 covers the outer braid 28.

The connector 10 comprises basically a shell 34 and a body 36 rotatable within the shell. The shell consists of a rear member 38 and a cylindrical forward member 40. The member 38 has a forwardly extending cylindrical hub 42 defining a forwardly facing shoulder 43. The rear end of the cylindrical member 40 is pressed over the hub 42 until it abuts the shoulder 43 thereby providing a firm mechanical connection between the members 38 and 40.

The body 36 has an outwardly extending annular flange 44 between its forward end 46 and its rear end 48. The flange abuts against a rearwardly facing shoulder 50 formed on the inner wall of member 40 so that the body cannot be removed from the shell. A cylindrical recess 52 opens at the forward end 46 of the body 36. The wall of the recess is threaded, as indicated at 54, to allow threaded engagement between the body 36 and the threaded fitting or outlet 12.

It is noted that the forward end 46 of the body is flush with the front end 55 of the shell so that when the connector 10 is mounted on the outlet 12 the body is inexcessible by hand or by conventional tools. Hence, the body and therefore the connector cannot be removed from the outlet 12 without the use of a special tool, to be described later.

The body 36 includes a rearwardly extending cylindrical hub 56 which extends into a cavity 58 in the front face of the rear member 38. A bore 60 in the hub 56 opens forwardly into the bore 54 in the body 36. A passage 62 coaxial with the axis of rotation of the body 36 extends from the bottom of the bore 60 to the rear of the hub. It is noted that the bores 54 and 60 are coaxial with the passage 62. The pin contact 18 extends through the passage 62. The forward end of the contact extends beyond the forward end 46 of the body 36. The pin contact extends rearwardly through a passage 64 in an insulator 66 mounted in a bore 68 extending from the bottom of the cavity 58 rearwardly through a threaded boss 70 on the rear of the shell 34. A coupling nut 72 is threadedly engaged with the boss 70. Means, not shown, are provided within the boss 70 for electrically connecting the outer braid 28 of the cable 24 to the shell 34 and for electrically connecting the inner conductor 26 of the cable to the rear end of the pin contact 18. The insulator 66 electrically isolates the pin contact from the shell 34. The body 36 is illustrated as being formed of plastic and therefore the forward portion of the pin 18 is electrically isolated from the shell 34 by the body. If the body 36 were formed of metal, then an insulative sleeve would have to be inserted within the passage 62 to isolate the contact 18 from the body 36 and hence the shell 34.

A pair of recesses 74 are formed in the forward end 46 of the body 36. The recesses are preferably diametrically opposed to each other. The recesses are adapted to receive the tool of the present invention which rotates the body 36 to unthread it from the fitting 12 even though the body is mounted entirely within the shell 34 of the connector.

Figure 2:
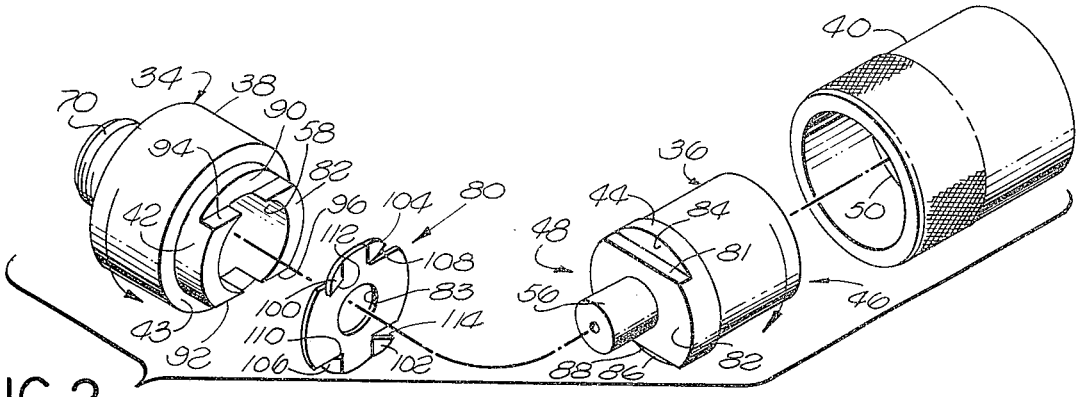
FIG. 2 is an exploded view of the components of the connector illustrated in FIG. 1.

The threads 54 on the body 36 are formed so that the body will threadedly engage the threaded outlet 12 upon clockwise rotation of the body in the direction indicated by the arrows in FIG. 2. According to the invention, one-way driving means is provided in the connector to effect clockwise rotation of the body 36 in response to clockwise rotation of the shell 34 so that the connector may be coupled to the outlet 12 by hand. On the other hand, the one-way driving means does not permit counterclockwise rotation of the body 36 during counterclockwise rotation of the shell 34 so that the body and hence the connector cannot be uncoupled from the fitting 12 by rotation of the shell 34. The one-way driving means comprises a spring washer 80 which is interposed between a rearwardly facing surface 81 on the body 36 and the forward surface 82 on member 38. The washer has a central circular opening 83 through which the hub 56 on the body 36 extends. The washer is therefore rotatable relative to both the body and the shell 34.

Figure 3:
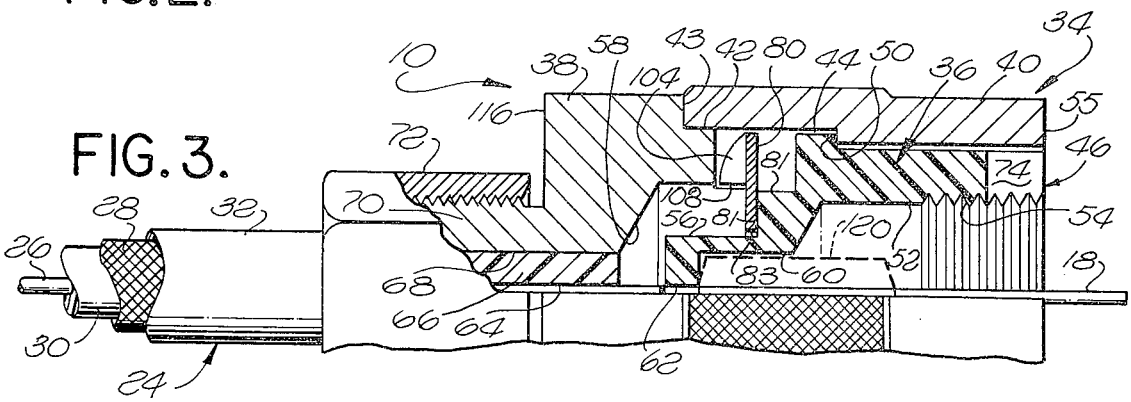
FIG. 3 is a partial longitudinal sectional view of the connector illustrated in FIG. 1.

Recesses 84 and 86 are formed on the diametrically opposed sides of the rear portion of the body 36 in front of the hub 56. Each recess opens at the outer perimeter of the flange 44 and rearwardly at the surface 82 of the body. The recess 84 defines a flat upperwardly facing surface 81 while the recess 86 defines a flat lower surface 88. The surface 81 and 88 are parallel to each other and are tangential to an imaginary circle which is coaxial with the axis of rotation of the body 36. The forward hub portion 42 of the shell 34 is also formed with a pair of recesses 90 and 92 defining flat upper and lower surfaces 94 and 96, respectively, which are parallel to each other and coplanar with the corresponding surfaces 80 and 88 on the body 36 when the body is rotatably positioned relative to the shell as shown in FIG. 3. It is noted that the cavity 58 in the ring member 38 of the shell intersects the upper and lower surfaces 94 and 96 so that the surfaces are interrupted. It will be appreciated that the surfaces could be continuous if the cavity 56 were of smaller diameter.

The spring washer 80 functions as a one-way driving clutch between the member 38 of shell 34 and the body 36. The washer 80 has a pair of forwardly bent tangs 100 and 102 and a pair of rearwardly bent tangs 104 and 106. The tangs 100 and 102 are diametrically opposed to each other as are the tangs 104 and 106. The tangs 102 and 104 are bent along an imaginary straight line which is tangential to an imaginary circle coaxial with the axis of the washer 80 while the tangs 100 and 106 are bent along a second imaginary straight line which is also tangential to such imaginary circle and parallel to the first line. Since the washer 80 is formed of a spring material, the tangs are resilient so that they may be shifted axially with respect to the main body of the washer 80 yet will spring back into their natural forwardly or rearwardly disposed positions.

When the washer 80 is positioned for imparting rotational movement from the shell 34 to the body 36, as shown in FIGS. 2 and 3, the downwardly facing edges 108 of the tang 104 engages the upper surface 94 on the hub 42 and the upwardly facing edge 110 on the tang 106 engages the lower surface 92 on the hub. The downwardly facing edge 112 on the tang 100 engages the upper surface 81 on the body 36 and the upwardly facing edge 114 on tang 102 engages the lower surface 88 on the body. It will therefore be appreciated that when the shell 36 is rotated in a clockwise direction indicated by the arrow in FIG. 2, the washer 80 will be rotated in the same direction. The washer will impart its clockwise rotation to the body 36 so that the body and hence the connector may be threaded onto the fitting 12 without the necessity of a tool. However, if the shell 34 is rotated in the counterclockwise direction, the hub 42 will ride over the rearwardly bent tangs 104 and 106, since the tangs are resilient and will bend forwardly, so that no rotation is imparted to the washer or to the connecting body 36. As a consequence, the connector 10 cannot be uncoupled from the fitting 12 by rotation of the shell 36.

The one-piece driving washer 80 of the present invention may be stamped out of a spring metal flat sheet. The driving tangs on the washer are integrally formed therewith thereby providing a one-way driving mechanism which is inexpensive to manufacture and easy to assemble.

While the connector 10 has been illustrated and described so far as being an electrical connector terminating a coaxial cable 24, it will be appreciated that the connector could be simply a protective terminator for the CATV outlet 12. In this case, the threaded boss 70 would be removed from the shell 34 and the shell would terminate at the rearwardly facing surface 116 of the rear member 38. The insulator 66 would be removed and the rear of the member 38 would be completely closed. The shell 34 would therefore prevent access to the outlet 12 by the homeowner. It is preferred that the socket contact 16 of the outlet 12 be connected to a load when an electrical connector is not coupled thereto. Therefore, it is desirable that a resistor be coupled to the socket contact. Such a resistor is shown in dotted lines in FIG. 3 and indicated by reference numeral 120. The resistor is positioned in the bore 60 in the body 36 and the forwardly extending lead thereon constitutes the pin contact 18 which will slide into the socket contact 16 in the outlet 12. The other lead of the resistor may pass through the passage 62 in the body 36.

Figure 4:
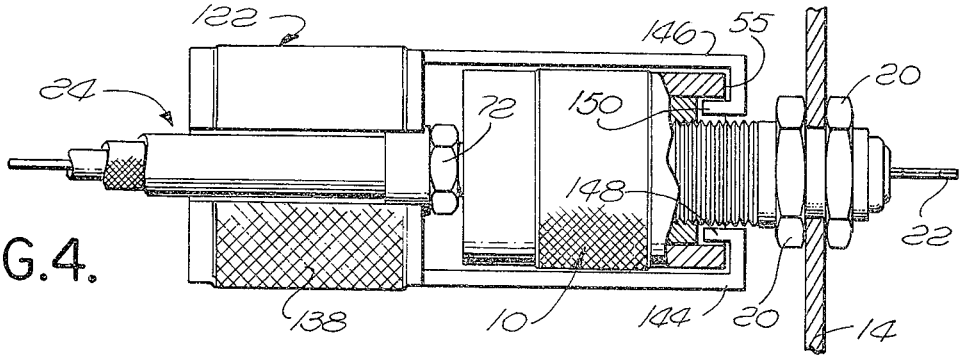
FIG. 4 is a side elevational view of the connector coupled to the CATV outlet, with the tool mounted over the connector in position to remove the connector from such outlet, with portions of the connector being illustrated in section to show the engagement of the tool with the rotatable body within the connector shell.

Reference is now made to FIGS. 1 and 4, which illustrate the preferred form of the tool 122 which is utilized for uncoupling the connector 10 from the fitting 12. The tool comprises a generally cylindrical hollow member 124 having a forward end 126 and rear end 128. The inner diameter of the hollow member 124 is slightly greater than the outer diameter of the shell 34 of connector 10 so that the tool may be mounted over the connector and rotated relative thereto. An opening 130 is formed in the wall of the hollow member 124 and extends from the forward end 126 thereof to a forwardly facing surface 132 spaced from the rear end 128 of the member. The opening is sufficiently large so that it can receive thereinto the connector 10 when the tool is mounted laterally over the connector. It is preferred that the opening 130 be almost a 180° cutout section from the hollow member 124. A longitudinally extending slot 136 extends from the surface 132 to the rear end 128 of the member 124. The slot is dimensioned so that it may slidably receive the cable 24 thereinto. The distance between the surface 132 and the forward end 126 of the hollow member 124 is slightly greater than the length of the connector 10. Preferably the rear portion of the hollow member 124 is knurled, as indicated at 138, to facilitate rotation of the tool after it has been mounted over the connector 10.

A pair of diametrically opposed hook elements 140 and 142 are provided at the forward end 126 of the hollow member 124. The hook elements 140 and 142 are connected to the hollow member by longitudinally extending arms 144 and 146, respectively. The hook elements define rearwardly extending fingers 148 and 150. These fingers are spaced apart a distance corresponding to the spacing between the recesses 74 on the front of the rotatable body 36 in the connector 10. In the embodiment shown, the ends of the fingers 148 and 150 are essentially coplanar with the forward end 126 of the hollow member 124, so that the ends of the fingers are spaced from the forwardly facing surface 132 on the tool a distance slightly greater than the length of the connector 10. As a consequence, the tool may be slid laterally over the connector. When the tool is so positioned, it partially surrounds the connector, and the fingers 148 and 150 will be adjacent to the forward end of the rotatable body 36. Since the fingers are spaced apart a distance corresponding to the spacing between the recesses 74, they may be positioned in alignment therewith when the tool is properly positioned coaxially over the connector. As a consequence, when the tool is retracted rearwardly with respect to the connector, the fingers 148 and 150 will slide into the recesses 74 in the inner rotatable body of the connector thereby providing a rotatable driving connection between the tool and the body. Consequently, when the tool is rotated in a counterclockwise direction, the body 36 will be rotated in the same direction to unthread the body and hence the connector from the CATV outlet 12.

While the recesses 74 have been shown as being diametrically opposed to each other, it will be appreciated that they could be disposed in different angular relationships just so the fingers on the tool are circumferentially disposed in a corresponding manner.

It will be appreciated that if the tool 122 is utilized just for removing a terminator device from the outlet 12, the slot 136 therein for a coaxial cable would not be required.

Figure 5:
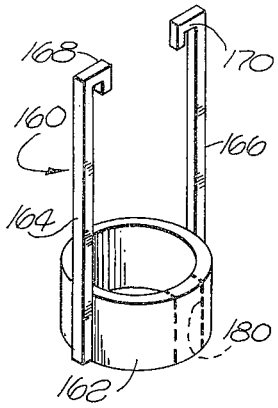
FIG. 5 illustrates a modified form of the tool of the present invention.

Reference is made to FIG. 5 which shows a modified form of the tool of the present invention generally designated 160. This tool comprises a ring-shaped support member 162 having a pair of diametrically opposed forwardly extending parallel arms 164 and 166. The arms terminate in hook elements 168 and 170, respectively, identical to the hook elements 140 and 142 on the tool 122. This form of tool may be utilized for uncoupling a terminator as previously described herein. By providing a longitudinally extending slot in the support member 162, as shown in dotted lines at 180, the tool could also be utilized for removing a connector having a cable attached thereto from the outlet 12. It will further be appreciated that the support member 162 need not be hollow when the tool is utilized for uncoupling termination devices from CATV outlets. For example, the support member could be simply a laterally extending bar or handle to which the arms 164 and 166 are rigidly connected.

From the foregoing, it is seen that by the present invention there is provided a connection device, which may be either an electrical connector or a terminator, for a CATV outlet which may be installed on the outlet without the use of any tool but requires a special tool for removal so that the device cannot be removed except by authorized personnel. The connector or termination device employs a novel and simple one-way driving washer which is inexpensive to manufacture and adaptable to mass production. The tool is also relatively simple and easy to handle, thereby permitting relatively unskilled technicians to remove the connector 10 from a CATV outlet.

What is claimed is:

1. A connector for a fitting comprising:

a hollow shell;

a body rotatable inside said shell, said body having a forward end and a rear end;

means preventing said body from being removed from said shell;

means adjacent to said forward end of said body for releasably coupling said body to said fitting upon rotation of said body in one direction;

a pair of spaced recesses opening at said forward end of said body adapted to receive a tool therein for rotating said body;

one-way driving means in said shell engaging said body effecting rotation of said body in said one direction upon rotation of said shell in the same direction, said one-way driving means effecting no rotation of said body upon rotation of said shell in the opposite direction whereby said body cannot be uncoupled from said fitting by rotation of said shell;

said one-way driving means comprising a one-piece spring metal washer;

said body having a pair of flat outwardly facing surfaces thereon in front of and adjacent to said washer, said surfaces being parallel to each other and tangential to an imaginary circle coaxial with the axis of rotation of said body;

said shell having a pair of flat outwardly facing surfaces thereon behind and adjacent to said washer, said surfaces being parallel to each other and coplanar with the corresponding surfaces on said body in one rotative position of said body relative to said shell;

said washer having a pair of integral forwardly extending one-way resilient driving tangs one generally diametrically opposed to the other, said one tang engaging one of said surfaces on said body and said other tang engaging the other of said surfaces on said body upon rotation of said shell in said one direction;

said washer having a pair of integral rearwardly extending one-way resilient driving tangs one generally diametrically opposed to the other, said one tang engaging one of said surfaces on said shell and said other tang engaging the other of said surfaces on said shell upon rotation of said shell in said one direction;

said surfaces on said body and said shell overriding said resilient tangs upon rotation of said shell in said opposite direction; and said tangs being bent from said washer along imaginary parallel lines tangential to a second imaginary circle coaxial with said axis.

* * * * *